US009472358B2

(12) United States Patent
Kawamura

(10) Patent No.: US 9,472,358 B2
(45) Date of Patent: Oct. 18, 2016

(54) ASSEMBLING STRUCTURE OF ELECTRONIC COMPONENT AND ELECTRICAL JUNCTION BOX

(71) Applicant: Yazaki Corporation, Tokyo (JP)

(72) Inventor: Yukihiro Kawamura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/847,298

(22) Filed: Sep. 8, 2015

(65) Prior Publication Data

US 2015/0380182 A1 Dec. 31, 2015

Related U.S. Application Data

(63) Continuation of application No. PCT/JP2014/056697, filed on Mar. 13, 2014.

(30) Foreign Application Priority Data

Mar. 14, 2013 (JP) ..... 2013-052271

(51) Int. Cl.
*H01H 9/20* (2006.01)
*H01H 45/02* (2006.01)

(52) U.S. Cl.
CPC ..... *H01H 9/20* (2013.01); *H01H 45/02* (2013.01); *H01H 2223/00* (2013.01)

(58) Field of Classification Search
CPC ..... H01H 9/20; H01H 45/14; H01H 9/02; H01H 2009/0285; H01H 45/02; H01R 13/684; H01R 13/68
See application file for complete search history.

(56) References Cited

U.S. PATENT DOCUMENTS 4,637,670 A * 1/1987 Coller ..... H05K 7/1046 439/180
4,710,134 A * 12/1987 Korsunsky ..... H05K 7/1007 439/264

(Continued)

FOREIGN PATENT DOCUMENTS

CN 1723141 A 1/2006
CN 1823459 A 8/2006

(Continued)

OTHER PUBLICATIONS

International Search Report of PCT/JP2014/056697 dated Jun. 10, 2014 [PCT/ISA/210] English Translation.

(Continued)

*Primary Examiner* — Ross Gushi
(74) *Attorney, Agent, or Firm* — Sughrue Mion, PLLC

(57) ABSTRACT

An electronic component includes a rectangular parallelepiped main body portion and at least one terminal portion which is provided in the main body portion, wherein a housing member includes a first housing chamber which guides and accommodates the main body portion and a second housing chamber which accommodates and holds a terminal fitting, the first housing chamber is formed by surrounding with a frame-shaped wall portion uprightly raised from a bottom portion on every side, the second housing chamber is formed at an outside with the wall portion interposed therebetween, the terminal portion includes a base end and a fitting portion which extends from a protruding front end of the base end along a side surface of the main body portion while being separated from the side surface and is fitted to the terminal fitting.

9 Claims, 14 Drawing Sheets

(56) References Cited

U.S. PATENT DOCUMENTS 4,883,428 A * 11/1989 Tonooka ..... H05K 7/1092 361/736
4,934,944 A * 6/1990 Kozel ..... H05K 7/1046 439/68
4,968,259 A * 11/1990 Korsunsky ..... H05K 7/1023 206/724
5,007,845 A * 4/1991 Grabbe ..... H05K 7/1023 439/330
5,192,215 A * 3/1993 Grabbe ..... H05K 7/1023 439/525
5,605,464 A * 2/1997 Ikesugi ..... G01R 1/0408 439/68
5,606,298 A 2/1997 Weiser
6,231,370 B1 * 5/2001 Morin ..... H01R 12/57 361/807
9,293,276 B2 * 3/2016 Kawamura ..... H01R 33/975
2006/0141820 A1 6/2006 Naito et al.
2006/0154532 A1 7/2006 Yamada et al.
2010/0271168 A1 10/2010 Niedzwiecki et al.
2013/0043971 A1 * 2/2013 Chen ..... H01H 85/2045 337/205
2013/0237078 A1 9/2013 Ikeda et al.
2014/0106580 A1 * 4/2014 Sato ..... B60R 16/0239 439/76.2
2015/0155121 A1 * 6/2015 Kawamura ..... H01H 50/048 439/722
2015/0163943 A1 * 6/2015 Kawamura ..... H01H 50/048 361/728
2015/0380181 A1 * 12/2015 Kawamura ..... H01R 9/2458 200/293
2015/0380182 A1 * 12/2015 Kawamura ..... H01H 45/02 200/293
2015/0382497 A1 * 12/2015 Kawamura ..... B60R 16/0238 361/728
2016/0006159 A1 * 1/2016 Kawamura ..... H01R 9/2425 439/540.1
2016/0006228 A1 * 1/2016 Kawamura ..... H02G 3/086 361/657
2016/0020049 A1 * 1/2016 Kawamura ..... H01R 13/73 200/51 R
2016/0020050 A1 * 1/2016 Kawamura ..... H01R 13/642 200/238
2016/0027599 A1 * 1/2016 Kawamura ..... H01R 13/113 335/202
2016/0049779 A1 * 2/2016 Kawamura ..... H02G 3/081 174/541
2016/0049780 A1 * 2/2016 Kawamura ..... H02G 3/18 174/541
2016/0050779 A1 * 2/2016 Kawamura ..... H02G 3/18 361/732

FOREIGN PATENT DOCUMENTS

CN 103730294 A 4/2014
JP 63-146939 U 9/1988
JP 09-140029 A 5/1997
JP 2001-167680 A 6/2001
JP 2010-221787 A 10/2010
JP 2012-119292 A 6/2012

OTHER PUBLICATIONS

Communication dated Aug. 23, 2016 from the State Intellectual Property Office of the P.R.C. in counterpart Application No. 201480014505.1.

* cited by examiner

ASSEMBLING STRUCTURE OF ELECTRONIC COMPONENT AND ELECTRICAL JUNCTION BOX

CROSS-REFERENCE TO RELATED APPLICATION

This application is a continuation application of International Application PCT/JP2014/056697, filed on Mar. 13, 2014, and designating the U.S., the entire contents of which are incorporated herein by reference.

BACKGROUND OF THE INVENTION

1. Field of the Invention

The present invention relates to an assembling structure of an electronic component assembling an electronic component, a terminal fitting of an electrical wire and a housing member accommodating the electronic component and the terminal fitting of the electrical wire, and an electrical junction box including the assembling structure.

2. Description of the Related Art

Generally, a vehicle such as an automobile is equipped with an electronic component module obtained by assembling various electronic components. Japanese Patent Application Laid-open No. 2010-221787 discloses a configuration of an electrical junction box (junction box) including a relay module in order to control a connection between a power supply and an electric component.

FIG. 18 illustrates an exemplary configuration of a relay module of a related art. Such a relay 90 includes a rectangular parallelepiped relay main body 91 and a plurality of plate-shaped terminal portions (hereinafter, referred to as relay terminals) 92 which linearly protrudes from one surface (a bottom surface) of the relay main body 91. This kind of the relay 90 is assembled to, for example, a resinous holding member 95 that holds a terminal fitting 94 connected to an electrical wire 93 so as to form a relay module, and the relay module is assembled to an electrical junction box. The terminal fitting 94 is provided with a spring portion 96 which is fitted to the relay terminal 92, and the relay 90 is held by the holding member 95 in a manner such that each of the front ends of the plurality of relay terminals 92 is inserted and fitted into the spring portion 96. In addition, FIG. 18 is basically a longitudinal sectional view of the relay module of the related art, but only the relay main body 91 is illustrated as a side view.

Incidentally, in the relay module of the related art illustrated in FIG. 18, the spring portion 96 which is fitted to the relay terminal 92 is formed in the terminal fitting 94, and the relay 90 is held by the holding member 95 in a manner such that each of the front ends of the plurality of relay terminals 92 is inserted and fitted into the spring portion 96. Accordingly, in a case where the relay terminal 92 is inserted into the spring portion 96, the relay 90 is easily inclined until the relay terminal 92 is fitted to the spring portion 96, and hence the posture is not stabilized. For this reason, the workability is poor when the relay 90 is assembled to the holding member 95. Particularly, even when the plurality of relays 90 are assembled to the holding member 95, the relays 90 need to be assembled while each relay terminal 92 is individually fitted to the spring portion 96. Thus, when the number of the relays 90 to be assembled increases, the workability is further degraded.

SUMMARY OF THE INVENTION

The present invention is contrived based on this circumstance, and an object of the present invention is to improve the workability when the electronic component is assembled to the electronic component module.

In order to achieve the above mentioned object, an assembling structure of an electronic component according to one aspect of the present invention includes an electronic component; at least one terminal fitting configured to be fitted to the electronic component; and a housing member configured to accommodate the electronic component and the terminal fitting, wherein the electronic component includes a rectangular parallelepiped main body portion and at least one terminal portion provided in the main body portion, the housing member includes a first housing chamber which guides and accommodates the main body portion and a second housing chamber which accommodates and holds the terminal fitting, the first housing chamber is formed by surrounding with a frame-shaped wall portion uprightly raised from a bottom portion on every side, and the second housing chamber is formed at an outside with the wall portion interposed therebetween, the terminal portion includes a base end and a fitting portion which extends from a protruding front end of the base end along a side surface of the main body portion while being separated from the side surface and is fitted to the terminal fitting, the fitting portion of at least one terminal portion is positioned so that the main body portion contacts the terminal fitting when at least one third of a height dimension of the main body portion is accommodated in the first housing chamber, and the electronic component, the terminal fitting, and the housing member are assembled each other.

According to the present invention, since a part of the main body portion can be guided and accommodated in the first housing chamber before the fitting portion of the terminal portion is fitted to the terminal fitting, it is possible to decrease the inclination degree of the fitting portion contacting the terminal fitting with the operation of accommodating the main body portion. Here, if at least one third of the height dimension of the main body portion is accommodated in the first housing chamber when the fitting portion contacts the terminal fitting, it is possible to stabilize the posture when the main body portion is accommodated in the first housing chamber later (regardless of gravity center position of the main body portion), and hence to improve the efficiency of the operation of assembling the electronic component.

In order to cause the fitting portion to contact the terminal fitting when at least one third of the height dimension of the main body portion is accommodated in the first housing chamber, there is a need to adjust the height positions of the fitting portion and the terminal fitting mutually. For example, in a case where the electronic component includes a plurality of terminal portions and the second housing chamber accommodates and holds the plurality of terminal fittings respectively fitted to the plurality of terminal portions, the fitting portions of the plurality of terminal portions are disposed so that the extension front ends are positioned at the same height position as an adjustment means, and hence the plurality of terminal fittings can be positioned at the same height position. Alternatively, the extension front ends of the fitting portions of a part or the entirety of the terminal portions among the plurality of terminal portions are positioned at different height positions as a different adjustment means, and hence a part or the entirety of the terminal fittings among the plurality of terminal fittings can be positioned at different height positions. In any adjustment means, the plurality of fitting portions contacting the terminal fittings when at least one third of the height dimension of the main body portion is accommodated in the first housing chamber can have an appropriate insertion direction before the fitting portions are fitted to the terminal fittings, and hence the fitting portions may be smoothly fitted to the terminal fittings.

Further, at least one of the plurality of terminal portions is provided in the opposite side surfaces of the main body portion, and the plurality of terminal fittings includes inclined portions which guide the fitting portions of the terminal portions. In this case, the terminal fittings may be positioned so that the inclined portions are inclined in the opposite direction at both sides with the main body portion interposed therebetween. Thus, when the fitting portions are respectively brought into contact with the inclined portions, the fitting portions can be regulated in the opposite direction with the main body portion interposed therebetween. Accordingly, since the fitting portions can be positioned to the terminal fittings, it is possible to further suppress the inclination of the electronic component, and hence to direct the fitting portion to a more appropriate insertion direction.

In the case of the electrical junction box including the above-described assembling structure of electronic component, it is possible to improve the efficiency of the operation of assembling the electronic component in the electrical junction box.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of an electronic component module providing an assembling structure of an electronic component according to the present invention will be described with reference to the accompanying drawings. Further, in the embodiment, a relay is described as an electronic component, but the electronic component is not limited to the relay. For example, other electronic components, for example, a fuse or a substrate module component having the same configuration as the relay to be described later can be used. Further, the application example of the relay module of the embodiment is not particularly limited. However, for example, a case can be supposed in which the relay module is used in an equipment controlling a connection state between a power supply and an electric component in a vehicle such as an automobile. This kind of relay module may be configured as one component of the electrical junction box. However, the relay module can be handled as a single component instead of the component of the electrical junction box, and may guarantee a relay function even in such a single component.

Figure 1:
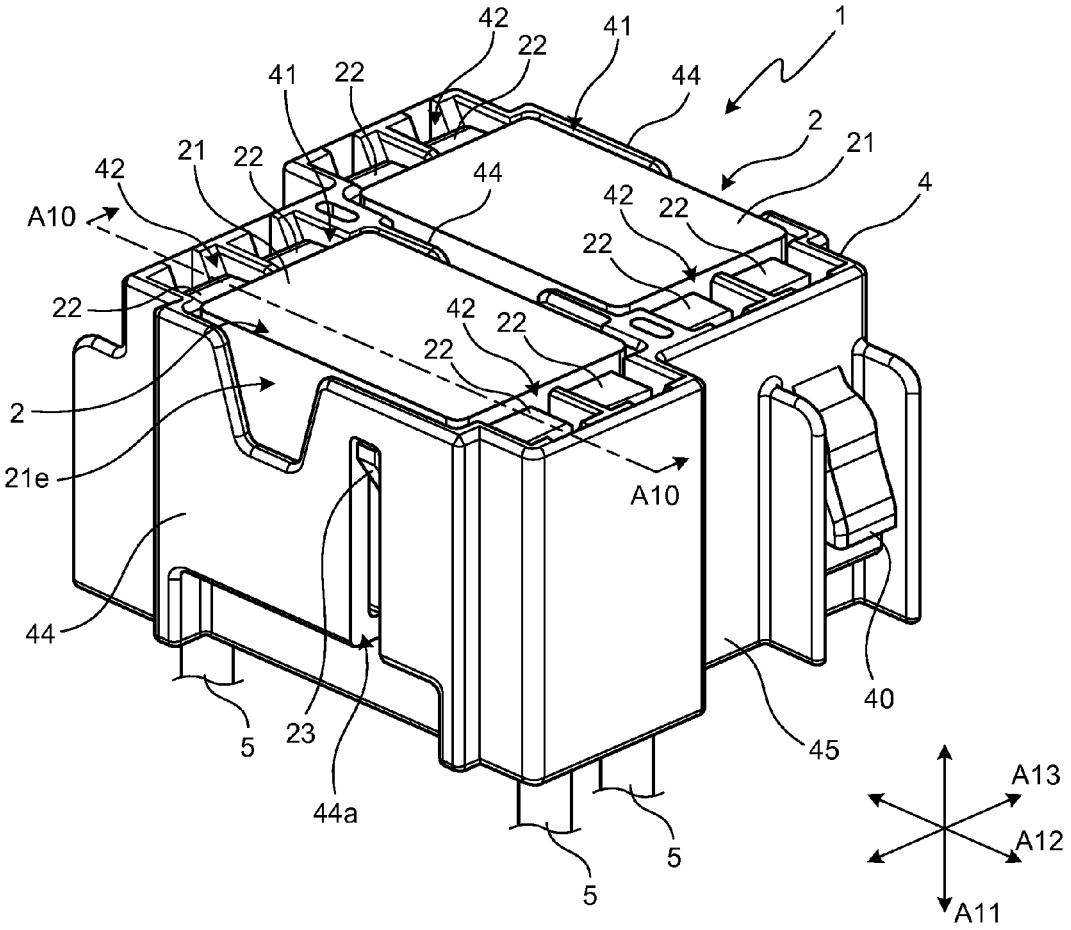
FIG. 1 is a perspective view illustrating an entire configuration of a relay module of the present invention obtained by assembling a relay, a terminal fitting, and a housing member.
Figure 2:
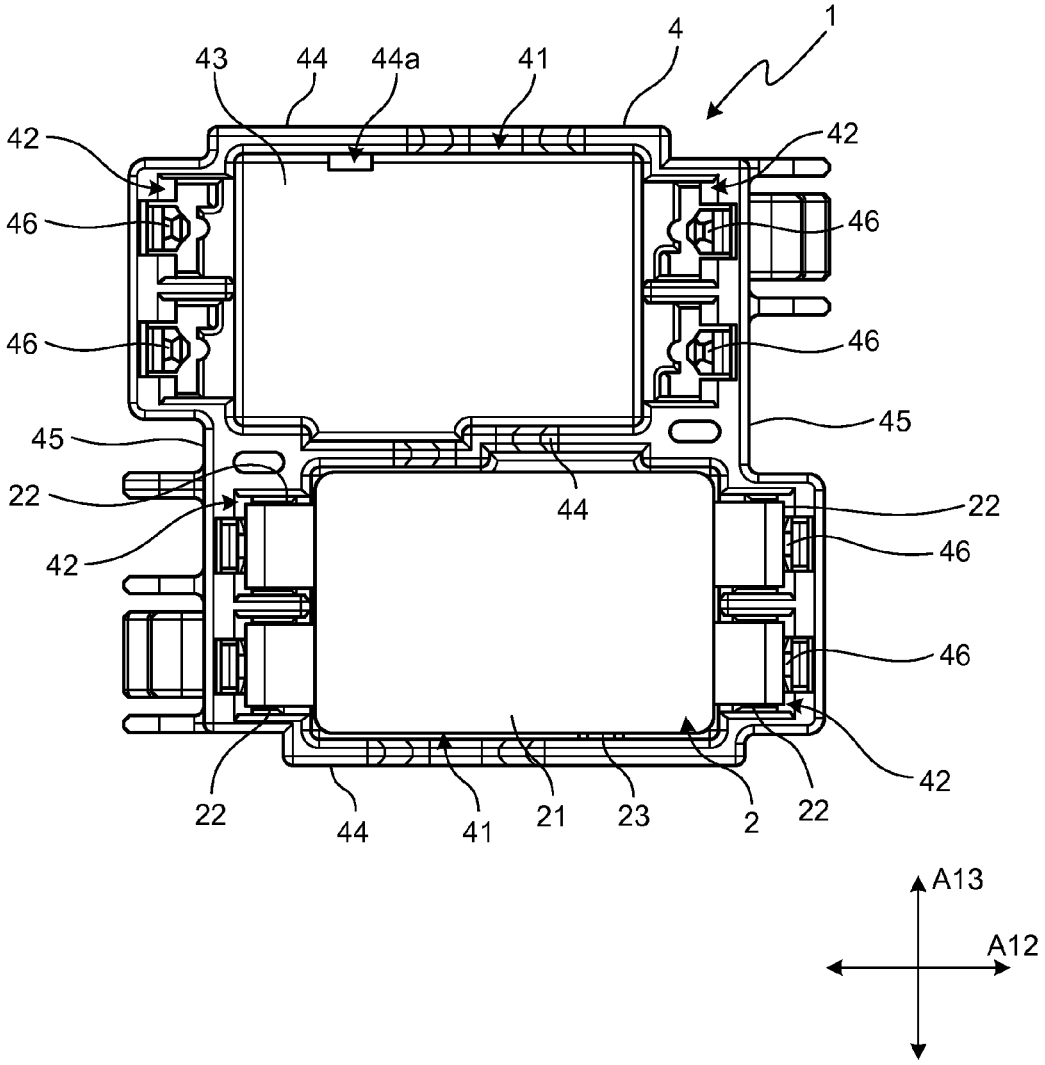
FIG. 2 is a top view of the relay module illustrated in FIG. 1 (where one of two relays is not illustrated in the drawings)
Figure 3A:
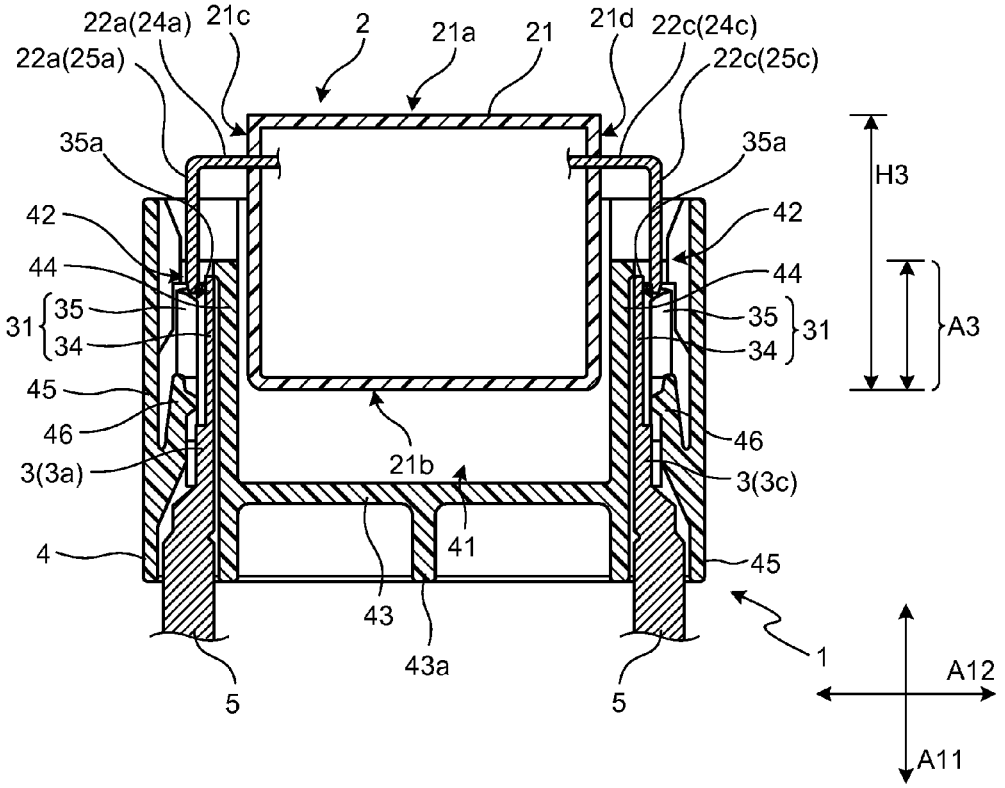
FIG. 3A is a diagram illustrating a longitudinal section of a relay module according to a first embodiment when viewed from the direction of the arrow A10 of FIG. 1 while a relay is assembled to a housing member.
Figure 3B:
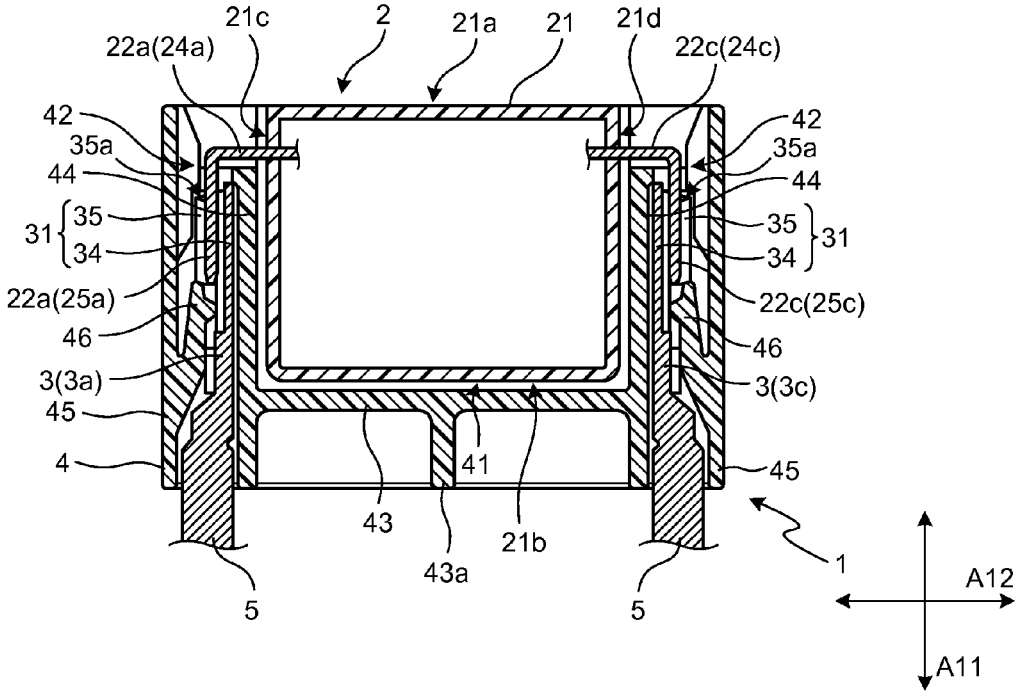
FIG. 3B is a diagram illustrating a longitudinal section of the relay module according to the first embodiment when viewed from the direction of the arrow A10 of FIG. 1 after the relay is assembled to the housing member.

FIGS. 1 to 3B illustrate a relay assembly structure according to a first embodiment of the present invention. FIG. 1 is an entire configuration diagram of a relay module 1 obtained by assembling a relay 2, a terminal fitting 3, and a housing member 4. FIG. 2 is a top view of such a relay module 1 (where one of two relays 2 is not illustrated). Further, FIGS. 3A and 3B illustrate a longitudinal section of the relay module 1 when viewed from the direction of the arrow A10 of FIG. 1, where FIG. 3A illustrates a state where the relay 2 is assembled to the housing member 4 and FIG. 3B illustrates a state after the relay 2 is assembled to the housing member 4. Further, in the following description of FIG. 1, the direction indicated by the arrow A11 is set as the up and down direction, the direction indicated by the arrow A12 is set as the left and right direction, and the direction indicated by the arrow A13 is set as the front to back direction (hereinafter, the same applies to the drawings other than FIG. 1). Further, regarding the up and down direction, the upward direction of FIG. 1 is set as the upward side (the upside) and the downward direction thereof is set as the downward side (the downside). However, the up and down direction, the left and right direction, and the front to back direction may not match the respective directions (for example, the up and down direction, the left and right direction, and the front to back direction of an automobile) in a state where the relay module 1 is actually mounted on a vehicle. Further, various components accommodated inside a relay main body 21 are not illustrated in FIGS. 3A and 3B (the same applies to FIGS. 6A and 6B).

In the embodiment, the relay module 1 includes the relay 2, the terminal fitting 3 (3*a* to 3*d*) which is fitted to the relay 2, and the housing member 4 that accommodates the relay 2 and the terminal fitting 3. The relay 2 includes a rectangular parallelepiped main body portion (hereinafter, referred to as a relay main body) 21 and at least one terminal portion (hereinafter, referred to as a tab) 22 provided in the relay main body 21. In the embodiment, as illustrated in FIG. 1, a case will be exemplified in which one relay module 1 includes two relays 2. However, the number of the relays constituting one relay module is not particularly limited. That is, the relay module may include only one relay or three or more relays. In addition, in a case where the relay module includes a plurality of relays, the relay module may include the relays 2 having the same shape as illustrated in FIG. 1. Alternatively, the relay module may include relays (for example, relays 2*a* to 2*k* illustrated in FIGS. 7 to 17) having different shapes.

Figure 4:
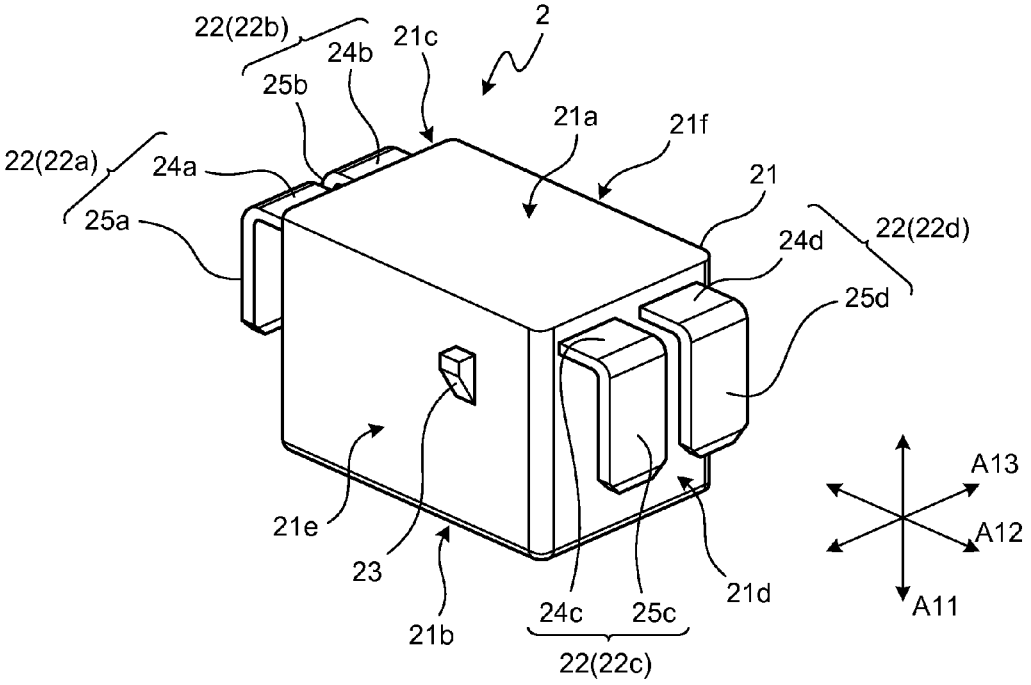
FIG. 4 is a perspective view illustrating a configuration of the relay according to the first embodiment.

FIG. 4 illustrates an example of the relay 2 according to the embodiment. In such a relay 2, the relay main body 21 is formed of a resin or the like, and a metallic tab 22 having a conductive property is provided in the relay main body 21. The relay main body 21 includes surfaces (hereinafter, referred to as a top surface 21*a* and a bottom surface 21*b*) which face each other in the up and down direction, surfaces (hereinafter, referred to as a left side surface 21*c* and a right side surface 21*d*) which face each other in the left and right direction, and surfaces (hereinafter, referred to as a front surface 21*e* and a back surface 21*f*) which face each other in the front to back direction. In this case, the relay main body 21 is positioned so that the left and right direction is set as the longitudinal direction and four side surfaces of the left side surface 21*c*, the right side surface 21*d*, the front surface 21*e*, and the back surface 21*f* become the side surfaces. Further, in the embodiment, the relay main body 21 is formed in a rectangular parallelepiped shape as an example, but the relay main body may be formed in a cubic shape.

The tab 22 includes a base end 24 (24*a* to 24*d*) which protrudes from the relay main body 21 and a fitting portion 25 (25*a* to 25*d*) which extends from the protruding front end of the base end 24 along the side surface while being separated from the side surface of the relay main body 21 and is fitted to the terminal fitting 3. In addition, the number, the width, or the thickness of the tab 22 may be arbitrarily set. For example, in a case where the relay 2 includes the plurality of tabs 22, all tabs 22 may have the same width and thickness, and each tab 22 may have a different width or thickness. Further, in each tab 22, the protruding position or the protruding length of the base end 24 from the relay main body 21 may be arbitrarily set, and is not particularly limited.

As illustrated in FIG. 4, the relay 2 according to the embodiment includes four tabs 22 of plate shape, where two tabs 22*a* and 22*b* are disposed on the left side surface 21*c* of the relay main body 21 and the other two tabs 22*c* and 22*d* are disposed on the right side surface 21*d*. In this case, four base ends 24*a* to 24*d* protrude by the same length (the same dimension in the left and right direction) from the same height (the same dimension as the same position from the bottom surface 21*b* in the up and down direction). Further, four fitting portions 25*a* to 25*d* extend substantially perpendicularly and downward from the protruding front ends of the base ends 24*a* to 24*d*.

Figure 5:
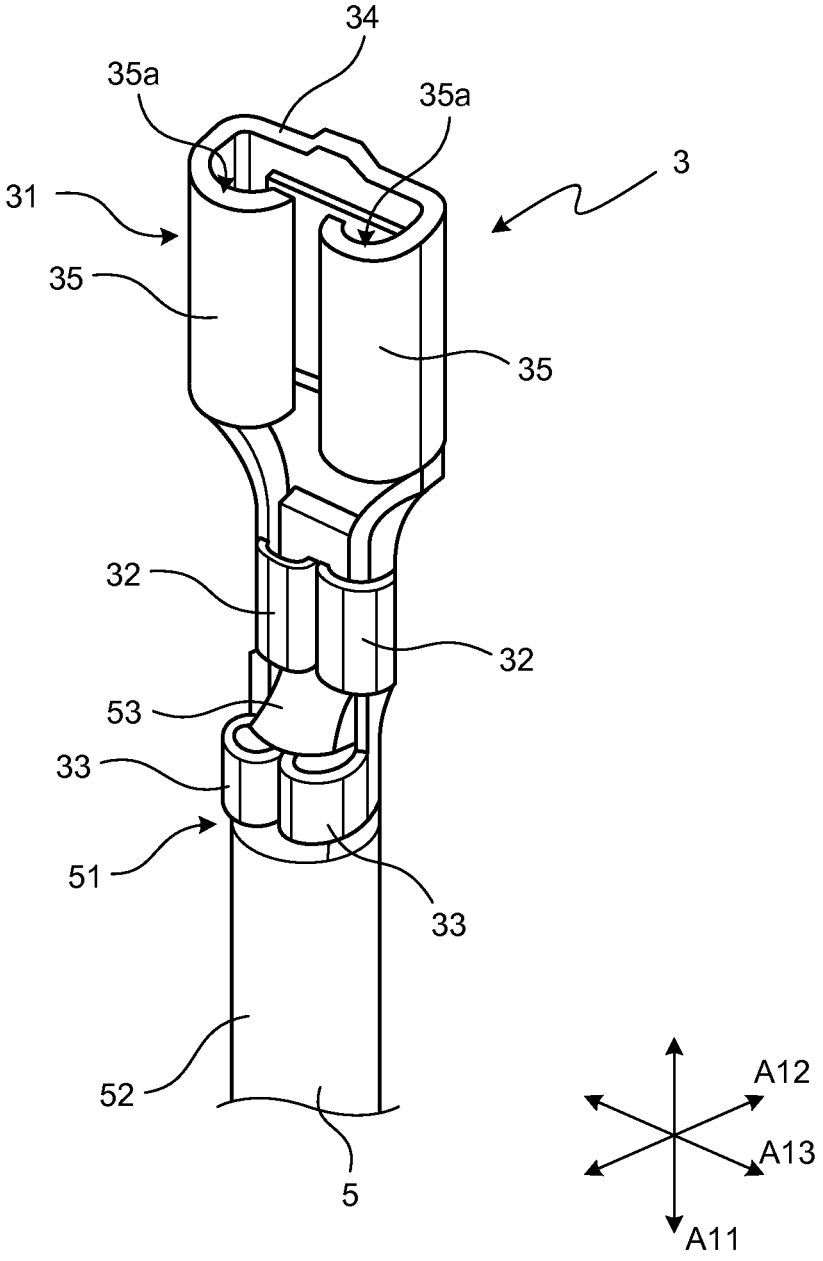
FIG. 5 is a perspective view illustrating a configuration of a terminal fitting according to the present invention.

FIG. 5 illustrates an example of a configuration of the terminal fitting 3 according to the embodiment. The terminal fitting 3 is an interface member that is connected to a terminal portion 51 of an electrical wire 5 in order to electrically connect the electrical wire 5 to the relay 2. Further, in FIG. 5, a configuration is exemplified in which the terminal fitting 3 is connected to the terminal portion 51 of the electrical wire 5, but the terminal fitting 3 may be connected to a connection substrate or a connector. The terminal fitting 3 is formed by processing a metallic plate member having a conductive property, and includes a female connection portion 31 into which the fitting portion 25 of the tab 22 is fitted, a pair of core wire crimping pieces 32 which crimps a core wire 53 obtained by peeling off an insulation coating 52 of the terminal portion 51 of the electrical wire 5 so that the terminal portion is exposed, and a pair of external crimping pieces 33 which crimps the front end portion of the insulation coating 52 of the electrical wire 5.

The connection portion 31 includes a flat plate portion 34 which is flat-plate-shaped and supports the fitting portion 25 of the fitted tab 22 and a spring portion 35 which presses the fitting portion 25, and hence the fitting portion 25 which is pressed against the flat plate portion 34 by the spring portion 35 is fitted between the flat plate portion 34 and the spring portion 35. The spring portion 35 is formed as a pair of convex curved portions in which both ends of the flat plate portion 34 in the front to back direction are uprightly formed and the front ends thereof are curved toward the vicinity of the center of the flat plate portion 34 in the front to back direction. Thus, the spring portion 35 elastically deforms the front end thereof in a direction in which the front end is separated from the flat plate portion 34 so that a pressing force (an elastic restoration force) is applied to the fitting portion 25 and the fitting portion 25 is fitted.

The spring portion 35 includes an inclined portion 35*a* which guides the fitting portion 25. In the embodiment, the inclined portion 35*a* is formed by inclining the upper end surface of the spring portion 35 so that the spring portion 35 is gently inclined downward from the most protruding portion with respect to the flat plate portion 34 toward the flat plate portion 34. Thus, the inclined portion 35*a* can guide the fitting portion 25 to a position between the flat plate portion 34 and the spring portion 35 when the fitting portion 25 of the tab 22 is fitted to the connection portion 31.

The housing member 4 is a resinous frame which accommodates and holds the relay 2 and the terminal fitting 3, and includes a first housing chamber 41 which guides and accommodates the relay main body 21 and a second housing chamber 42 which accommodates and holds the terminal fitting 3. Further, in the embodiment, the housing member 4 is handled as a single member separated from the electrical junction box. For this reason, the housing member 4 is provided with a locking portion 40 which can engage with a target locking portion (for example, a locking groove), provided in the frame of the electrical junction box, so as to be attached to the frame. When the locking portion 40 engages with such a target locking portion, the housing member 4 can be locked and attached to the frame of the electrical junction box. However, a configuration can be employed in which the housing member 4 is formed as a part of the frame of the electrical junction box so as not to be separable from the electrical junction box. Further, the numbers of the relays 2 and the terminal fittings 3 accommodated in the housing member 4 are not particularly limited. In the embodiment, as illustrated in FIG. 1, a configuration is exemplified in which one housing member 4 accommodates two relays 2. In other words, the housing member 4 includes two pairs of relay accommodating spaces each including one first housing chamber 41 and two second housing chambers 42. Since the relay 2 is provided with four tabs 22, eight terminal fittings 3 are accommodated in one housing member 4. These tabs 22 are provided so that two tabs are provided in each of the left side surface 21*c* and the right side surface 21*d* of the relay main body 21. For this reason, the pair of second housing chambers 42 is disposed so as to face each other with the first housing chamber 41 interposed therebetween in the housing member 4, and each second housing chamber 42 accommodates and holds two terminal fittings 3.

Here, as illustrated in FIG. 3B, the height position of the relay main body 21 in a state where the relay 2 is assembled to the housing member 4 is positioned by the position where the fitting portion 25 of the tab 22 is fitted to the connection portion 31 of the terminal fitting 3. An upper end surface of a wall portion 44 is positioned to a predetermined height below an upper end surface of a frame portion 45 so as not to contact the base end 24 of the tab 22 when the fitting portion 25 of the tab 22 is fitted to the connection portion 31 of the terminal fitting 3, and a bottom portion 43 is positioned to a predetermined height so as not to contact the bottom surface 21*b* of the relay main body 21. Thus, since the relay 2 is held in the housing member 4 without the interference with the upper end surface of the wall portion 44 or the bottom portion 43 except for a portion in which the fitting portion 25 of the tab 22 is fitted to the connection portion 31 of the terminal fitting 3 in the height direction of the housing member 4, it is possible to ensure the connection between the tab 22 and the terminal fitting 3 and hence to stabilize the holding force for the relay 2.

As illustrated in FIGS. 1 to 3B, the first housing chamber 41 is formed in a concave space which is surrounded by the frame-shaped wall portion 44 upright formed from the bottom portion 43 on every side and of which the upside is opened to the outside. The wall portion 44 is uprightly formed from the bottom portion 43 so as to surround the side surface (the left side surface 21*c*, the right side surface 21*d*, the front surface 21*e*, and the back surface 21*f*) of the relay main body 21 on every side, and hence the relay main body 21 is guided and accommodated by the first housing chamber 41. In this case, the first housing chamber 41 is formed in a substantially rectangular parallelepiped shape larger than the relay main body 21 so as to smoothly accommodate the relay main body 21 guided by the wall portion 44.

In addition, as illustrated in FIG. 1, the wall portion 44 which is uprightly formed so as to directly face the front surface 21*e* of the relay main body 21 is provided with a locking groove 44*a* which engages with a protrusion portion 23 provided in the front surface 21*e*. Thus, in a state where the relay main body 21 is accommodated in the first housing chamber 41, the protrusion portion 23 engages with the locking groove 44*a*, and hence the relay main body 21 can engage with the first housing chamber 41. That is, it is possible to assist the assembling force between the relay 2 and the housing member 4 due to the fitting between the tab 22 and the terminal fitting 3 when the protrusion portion 23 and the locking groove 44*a* engage with each other. When the assist of the assembling force is unnecessary, the protrusion portion 23 and the locking groove 44*a* may not be provided. Further, as illustrated in FIGS. 3A and 3B, the bottom portion 43 may be provided with a reinforcement rib 43*a* which protrudes downward.

The second housing chamber 42 is formed as a rectangular parallelepiped space which is formed outside the first housing chamber 41 with the wall portion 44 interposed therebetween and is surrounded by a rectangular cylindrical frame formed by the wall portion 44 and the frame portion 45 of the housing member 4 so that the upside and the downside are opened to the outside. The second housing chamber 42 is provided with a locking piece (hereinafter, referred to as a lance) 46 which is elastically deformable so as to hold the terminal fitting 3.

A lance 46 is formed of the same resin as the housing member 4, and is stretched in a cantilevered state from the frame portion 45 toward the spring portion 35. That is, the lance 46 is formed as a so-called spring mechanism, and presses and locks the lower edge of the spring portion 35 by a restoration force from the elastic deformation state. Thus, the terminal fitting 3 is held in the second housing chamber 42 while the separation of the terminal fitting 3 from the second housing chamber 42 is prevented. As illustrated in FIGS. 3A and 3B, the terminal fittings 3 are positioned so that the inclined portions 35*a* are inclined in the opposite direction with the relay main body 21 interposed therebetween.

Then, the relay 2 is assembled to the housing member 4 while the terminal fitting 3 is held in the second housing chamber 42. In the embodiment, at least one fitting portion 25 of the tab 22 is positioned so as to contact the terminal fitting 3 when at least one third (which is a portion corresponding to the height A3 from the bottom surface 21*b* illustrated in FIG. 3A to the upper end surface of the wall portion 44 and will be referred to as the minimum accommodating portion A3 hereinbelow) of the height dimension (the dimension H3 illustrated in the same drawing) of the relay main body 21 is accommodated in the first housing chamber 41. Accordingly, since the minimum accommodating portion A3 of the relay main body 21 can be guided and accommodated in the first housing chamber 41 before the fitting portion 25 of the tab 22 is fitted to the terminal fitting 3, the inclination of the fitting portion 25 contacting the terminal fitting 3 can be decreased with the accommodation of the minimum accommodating portion A3. Here, if the minimum accommodating portion A3 of the relay main body 21 is accommodated in the first housing chamber 41 when the fitting portion 25 contacts the terminal fitting 3, it is possible to stabilize a posture in which the relay main body 21 is accommodated in the first housing chamber 41 (regardless of gravity center position of the relay main body 21) later. Accordingly, since the fitting portion 25 is fitted to the terminal fitting 3 in the appropriate insertion direction just when the relay main body 21 is pressed into the first housing chamber 41, the relay 2 can be smoothly accommodated in the housing member 4, and hence the efficiency of the attachment operation for the relay 2 can be improved.

Further, in the embodiment, if at least the minimum accommodating portion A3 is accommodated in the first housing chamber 41, the subsequent posture of the relay main body 21 is stabilized and the minimum accommodating portion A3 is set to at least one third of the height dimension H3 of the relay main body 21 so as to suppress the inclination of the relay 2 until the fitting portion 25 is directed toward the terminal fitting 3 in the appropriate insertion direction (the downside in the up and down direction). If the inclination of the relay 2 can be suppressed in such a degree, the height of the minimum accommodating portion A3 can be changed.

Further, the relay 2 can be placed on the housing member 4 while the minimum accommodating portion A3 of the relay main body 21 is accommodated in the first housing chamber 41 and at least one fitting portion 25 contacts the terminal fitting 3. At that time, even when there is the fitting portion 25 which does not contact the terminal fitting 3 among the plurality of fitting portions 25, the contacting fitting portion 25 is fitted to the terminal fitting 3 so that the fitting portion 25 contacting the terminal fitting 3 can be smoothly fitted to the terminal fitting 3. As a result, the workability is not degraded.

In order to cause the fitting portion 25 to contact the terminal fitting 3 when the minimum accommodating portion A3 of the relay main body 21 is accommodated in the first housing chamber 41, there is a need to adjust the height positions of the fitting portion 25 and the terminal fitting 3. Here, in the embodiment, as an example, the extension front ends of the fitting portions 25*a* to 25*d* of the tabs 22*a* to 22*d* are positioned at the same height, and the plurality of terminal fittings 3 is positioned at the same height. In this case, when the minimum accommodating portion A3 of the relay main body 21 is accommodated in the first housing chamber 41, the plurality of fitting portions 25*a* to 25*d* contacting the terminal fittings 3 can be smoothly fitted to the terminal fittings 3 since the insertion direction is appropriately set before the fitting portion is fitted to the terminal fitting 3. In addition, in order to position the extension front ends of the fitting portions 25*a* to 25*d* at the same height, the fitting portions 25*a* to 25*d* may extend by the same dimension from the protruding front ends of the base ends 24*a* to 24*d*.

FIGS. 3A and 3B illustrate a case where the relay 2 is assembled to the housing member 4 while the fitting portion 25 of the tab 22 according to the embodiment is fitted to the terminal fitting 3. In a case where the relay 2 is assembled to the housing member 4, as illustrated in FIG. 3A, the minimum accommodating portion A3 of the relay main body 21 may be accommodated in the first housing chamber 41. Thus, it is possible to direct the fitting portions 25*a* and 25*c* of the tab 22*a* and the tab 22*c* toward the appropriate insertion direction. Further, since the fitting portions 25*a* and 25*c* contact the terminal fittings 3*a* and 3*c* at the same height positions on both sides in the left and right direction in this state, it is possible to suppress the relay 2 from being inclined in the left and right direction. Further, since the terminal fittings 3*a* and 3*c* are positioned so that the inclined portions 35*a* are inclined in the opposite direction on both sides with the relay main body 21 interposed therebetween (on both sides in the left and right direction), the positions of the fitting portions 25*a* and 25*c* contacting the inclined portions 35*a* can be respectively uniformly regulated in the opposite direction of the left and right direction. Accordingly, since the fitting portions 25*a* and 25*c* can be positioned to the terminal fittings 3 on both sides in the left and right direction, it is possible to further suppress the inclination of the relay 2 in the left and right direction, and hence to direct the fitting portions 25*a* and 25*c* toward a more appropriate insertion direction. Further, since the fitting portions 25*a* and 25*c* and the fitting portions 25*b* and 25*d* arranged in the front to back direction contact the terminal fittings 3*b* and 3*d*, the relay 2 can be uniformly supported in the front to back direction, and hence the inclination of the relay 2 in the front to back direction can be suppressed. In addition, as illustrated in FIGS. 3A and 3B, the inclination of the inclined portion 35*a* of each terminal fitting 3 may be a direction which is inclined downward from the frame portion 45 toward the wall portion 44. However, a direction may be set in which the terminal fitting 3 is reversed so as to be inclined downward from the wall portion 44 toward the frame portion 45. Even in this case, the fitting portions 25*a* and 25*c* can be positioned in the same way.

In this way, in the embodiment, since the minimum accommodating portion A3 of the relay main body 21 is accommodated in the first housing chamber 41 before the fitting portion 25 is fitted to the terminal fitting 3, the relay 2 can easily take an appropriate posture (a posture in which the relay 2 follows the up and down direction without being inclined with respect to the housing member 4) (a state illustrated in FIG. 3A). Then, since all fitting portions 25 can contact the terminal fittings 3 in the appropriate insertion direction before the fitting portions 25 are fitted to the terminal fittings 3, the fitting portions 25 can be fitted to the terminal fittings 3 just when the contacting fitting portions are directly inserted into the terminal fittings (a state illustrated in FIG. 3B). Thus, it is possible to improve the workability when the relay 2 is assembled to the housing member 4.

Further, since the relay 2 placed on the housing member 4 takes an appropriate posture while all fitting portions 25 contact the terminal fittings 3, the top surface 21*a* of the relay main body 21 can be maintained substantially horizontally (on the plane in both the left and right direction and the front to back direction). Accordingly, even when the plurality of relays 2 is assembled to the housing member 4, the top surfaces 21*a* of the relay main bodies 21 can be maintained horizontally (on the same plane) when the fitting portions 25 of the relays 2 contact the terminal fittings 3. For this reason, the top surfaces 21*a* can be easily pressed uniformly at the same time, and hence the plurality of relays 2 can be pressed into the housing member 4 at the same time. Thus, since the contacting fitting portions 25 can be fitted into the terminal fittings 3 at the same time, it is possible to improve the workability when the fitting portions 25 of the plurality of relays 2 are fitted to the terminal fittings 3. In addition, in a case where the plurality of relays 2 is pressed into the housing member 4 at the same time, a working instrument may be used which applies a uniform pressing force while covering the top surfaces 21*a* of the relay main bodies 21.

Here, in the embodiment, the extension front ends of the fitting portions 25 are positioned at the same height and the terminal fittings 3 are positioned at the same height in order to cause the fitting portions 25 to contact the terminal fittings 3 when the minimum accommodating portion A3 of the relay main body 21 is accommodated in the first housing chamber 41. However, the configuration for the contact timing is not limited thereto. For example, a configuration may be employed in which a part or the entirety of the extension front ends of the fitting portions 25 of the tabs 22 among the plurality of tabs 22 are positioned at different height positions and a part or the entirety of the terminal fittings 3 among the plurality of terminal fittings 3 are positioned at different height positions. A configuration having different height positions will be described below as a second embodiment of the present invention. In addition, since a basic configuration of a relay module 10 according to the second embodiment is similar to that of the relay module 1 according to the first embodiment, the same reference sign of the drawing will be given to the component equivalent or similar to the first embodiment, and a difference from the first embodiment will be described below.

Figure 6A:
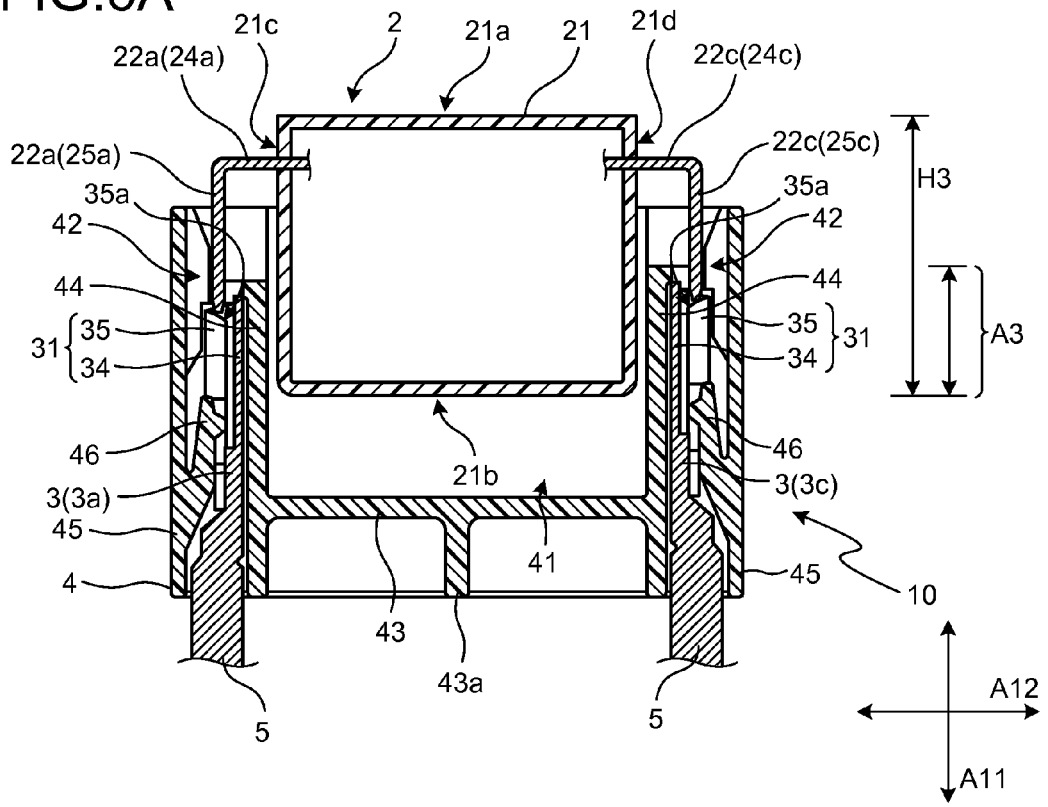
FIG. 6A is a diagram illustrating a longitudinal section of a relay module according to a second embodiment when viewed from the direction corresponding to the arrow A10 of FIG. 1 while a relay is assembled to a housing member.
Figure 6B:
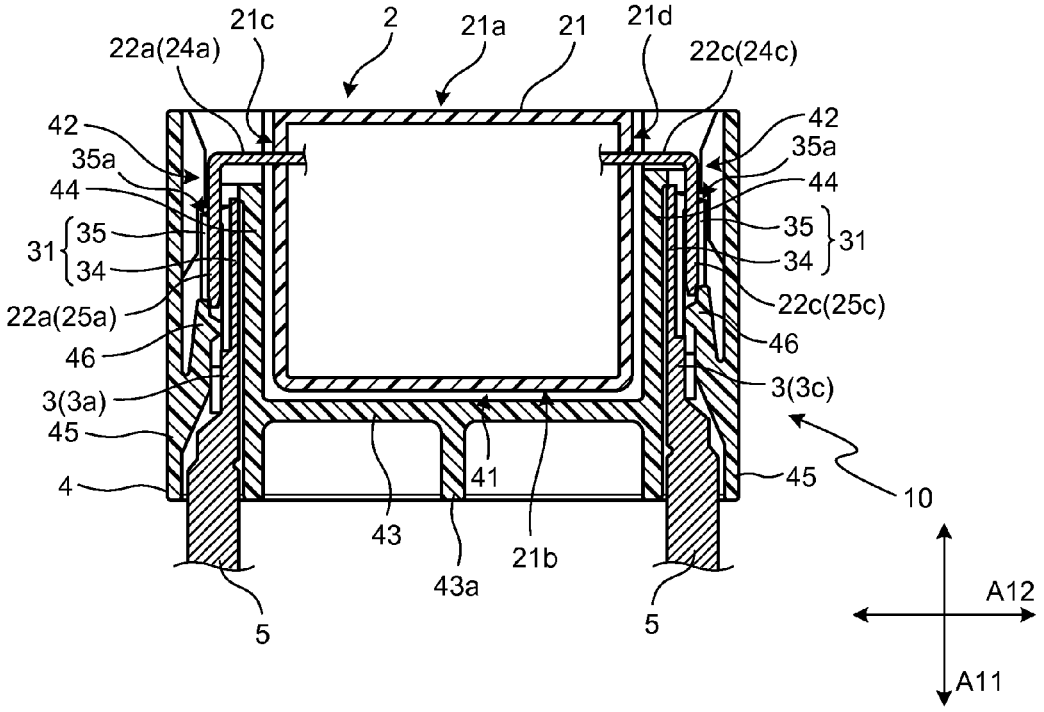
FIG. 6B is a diagram illustrating a longitudinal section of the relay module according to the second embodiment when viewed from the direction corresponding to the arrow A10 of FIG. 1 after the relay is assembled to the housing member.

FIGS. 6A and 6B illustrate a longitudinal section of the relay module 10 according to the second embodiment when viewed from the direction corresponding to the arrow A10 of FIG. 1, where FIG. 6A illustrates a state where the relay 2 is assembled to the housing member 4 and FIG. 6B illustrates a state after the relay 2 is assembled to the housing member 4. As an example, FIGS. 6A and 6B illustrate a configuration in which the extension front ends of the fitting portions 25*a* and 25*c* are positioned at different height positions and the terminal fittings 3*a* and 3*c* fitted to the fitting portions 25*a* and 25*c* are positioned at different height positions. In this case, the height position of the extension front end of the fitting portion 25*a* is set to be lower than the fitting portion 25*c*, and the height position of the terminal fitting 3*a* is set to be lower than the terminal fitting 3*c*. Specifically, the terminal fittings 3*a* and 3*c* are held by the second housing chamber 42 so that the height position of the terminal fitting 3*a* becomes lower than the terminal fitting 3*c* by the difference in height between the extension front ends of the fitting portions 25*a* and 25*c*.

In addition, in this case, the height positions of the fitting portions 25*b* and 25*d* of the tabs 22*b* and 22*d* and the terminal fittings 3*b* and 3*d* fitted thereto may be the same height position as in the fitting portions 25*a* and 25*c* and the terminal fittings 3*a* and 3*c* illustrated in FIGS. 3A and 3B, and may be different height positions as in the fitting portions 25*a* and 25*c* and the terminal fittings 3*a* and 3*c* illustrated in FIGS. 6A and 6B. In brief, if at least one fitting portion 25 may contact the terminal fitting 3 when the minimum accommodating portion A3 of the relay main body 21 is accommodated in the first housing chamber 41, the height positions of the other fitting portions 25 and the terminal fittings 3 can be arbitrarily set.

Further, in the relay according to the present invention, the tab 22 is formed so as to include the base end 24 which protrudes from the rectangular parallelepiped relay main body 21 and the fitting portion 25 which extends from the protruding front end of the base end 24 along the side surface of the relay main body 21 while being separated from the side surface so as to be fitted to the terminal fitting 3. The present invention is not limited to the configuration illustrated in FIG. 4 as long as at least one fitting portion 25 contacts the terminal fitting 3 when the minimum accommodating portion A3 is accommodated. For example, a relay configuration according to a first modified example to an eleventh modified example illustrated in FIGS. 7 to 17 can be employed, and the same operation and effect as the relay 2 can be obtained even in these modified examples.

Hereinafter, a relay configuration according to a first modified example to an eleventh modified example will be described. In addition, since the basic configuration of the relay according to the modified examples is the same as that of the relay 2 according to the embodiment, the same reference sign of the drawing will be given to the component equivalent or similar to the embodiment, and the description thereof will be omitted. In the description below, a difference from the relay 2 will be described. Further, in the relay configuration according to the modified examples, the terminal fitting 3 and the housing member 4 are set so that the first housing chamber 41 and the second housing chamber 42 are disposed in the housing member 4 so as to correspond to such a relay configuration (specifically, the arrangement of the tab of the relay). That is, a configuration may be employed in which the position of the second housing chamber 42 with respect to the first housing chamber 41 is set and the terminal fitting 3 is held in the second housing chamber 42. At that time, the terminal fitting 3 may be positioned at a height in which at least one fitting portion 25 may contact the terminal fitting when the minimum accommodating portion A3 of the relay main body 21 is accommodated in the first housing chamber 41. Further, in any modified example, the number of the tabs 22 and the protrusion position or the protrusion length of the base end 24 can be arbitrarily set.

Figure 7:
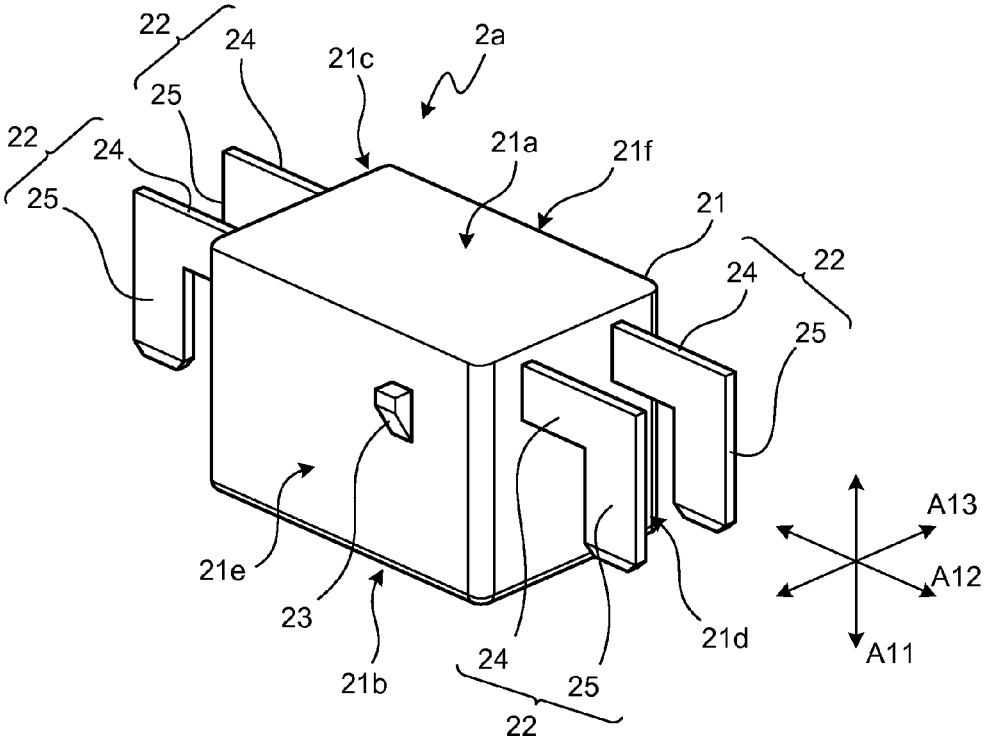
FIG. 7 is a perspective view illustrating a configuration of a relay according to a first modified example.

FIG. 7 illustrates a configuration of a relay 2*a* according to the first modified example. In such a relay 2*a*, the tab 22 is formed in a flat plate shape in which the base end 24 and the fitting portion 25 extend in parallel to the front surface 21*e* and the back surface 21*f*. In this case, the relay 2*a* includes four tabs 22, two tabs 22 are provided in the left side surface 21*c* of the relay main body 21, and two tabs 22 are provided in the right side surface 21*d* thereof. The base ends 24 of the four tabs 22 protrude by the same length form the same height (the same position in the up and down direction). Further, two tabs 22 of the side surfaces (the left side surface 21*c* and the right side surface 21*d*) respectively protrude from the side surfaces with the same interval (which may be different in some cases).

Further, in the relay configuration illustrated in FIGS. 4 and 7, the base ends 24 of the tabs 22 protrude from the pair of side surfaces (the left side surface 21*c* and the right side surface 21*d*) located in the longitudinal direction (the left and right direction) of the relay main body 21, but the base end 24 may protrude from one side surface, two adjacent side surfaces, or two or more side surfaces.

Figure 8:
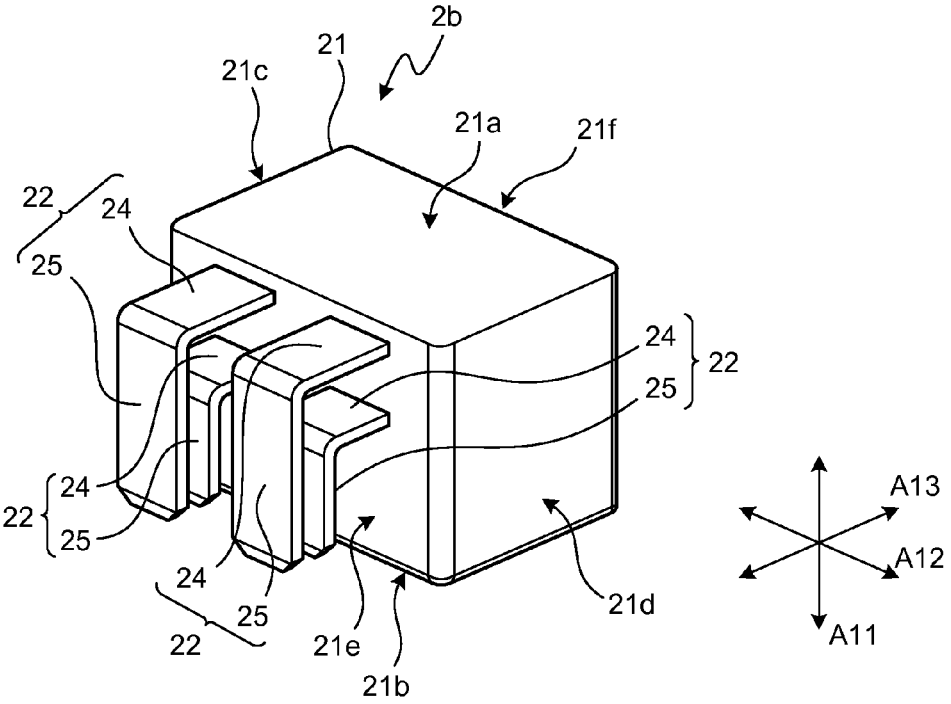
FIG. 8 is a perspective view illustrating a configuration of a relay according to a second modified example.
Figure 9:
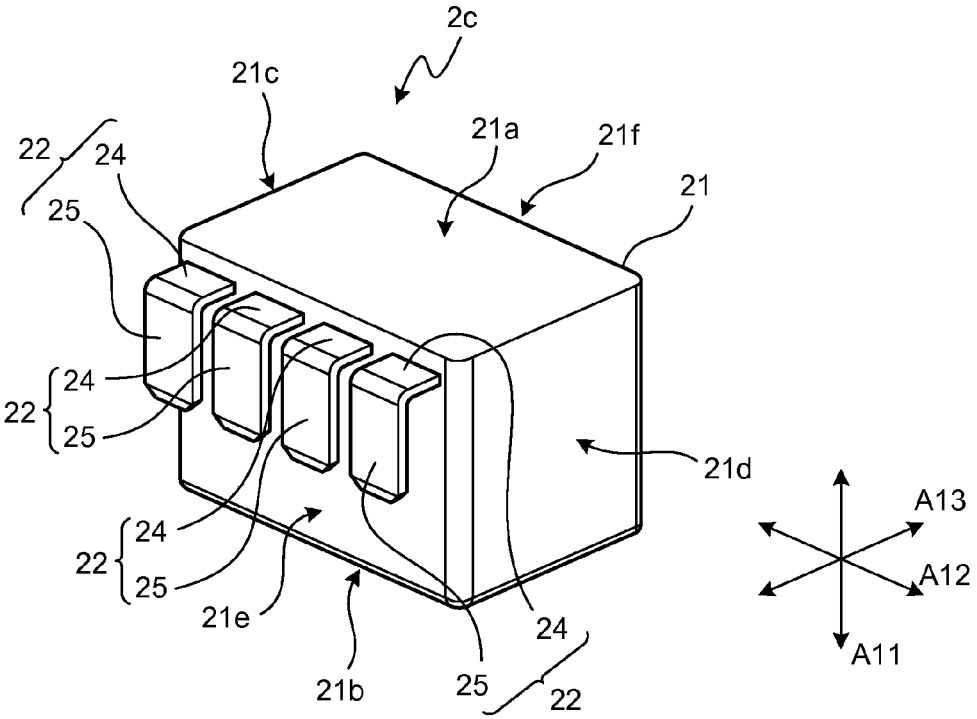
FIG. 9 is a perspective view illustrating a configuration of a relay according to a third modified example.

FIGS. 8 and 9 illustrate configurations of a second modified example and a third modified example in which the base end 24 of the tab 22 protrudes from one side surface (the front surface 21*e*) of the relay main body 21. In a relay 2*b* according to the second modified example illustrated in FIG. 8, two base ends 24 of the tabs 22 of four tabs 22 protrude from the vicinity of the upper end of the front surface 21*e* and the rest two base ends 24 of the tabs 22 protrude from the lower side thereof. On the contrary, in a relay 2*c* according to the third modified example illustrated in FIG. 9, the base ends 24 of four tabs 22 protrude from the same height in the vicinity of the upper end of the front surface 21*e*.

Figure 10:
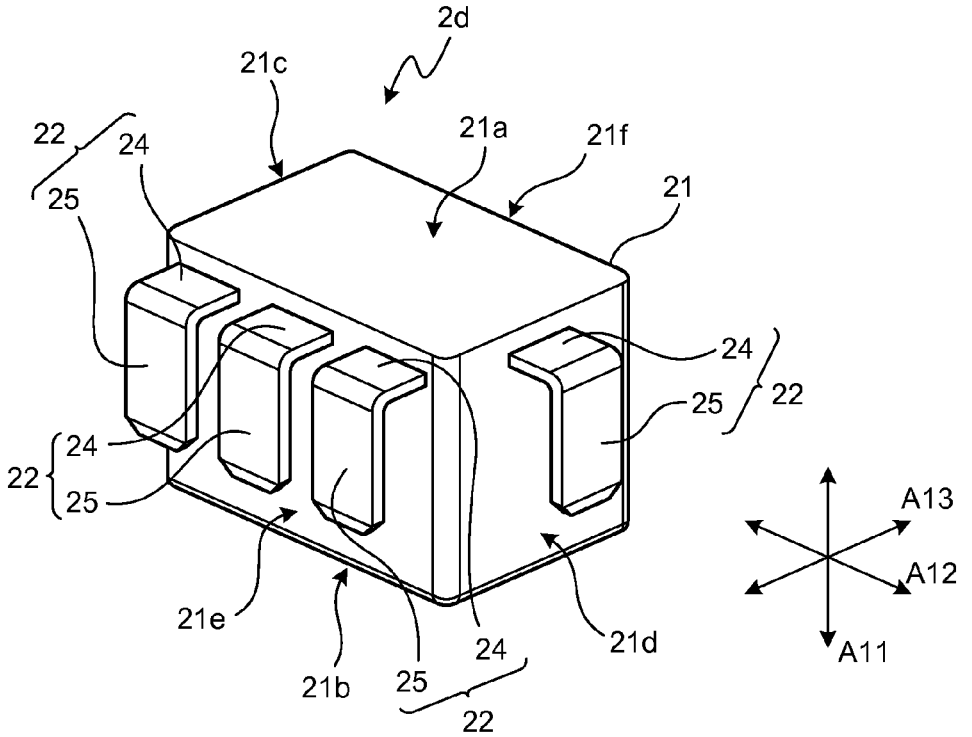
FIG. 10 is a perspective view illustrating a configuration of a relay according to a fourth modified example.
Figure 11:
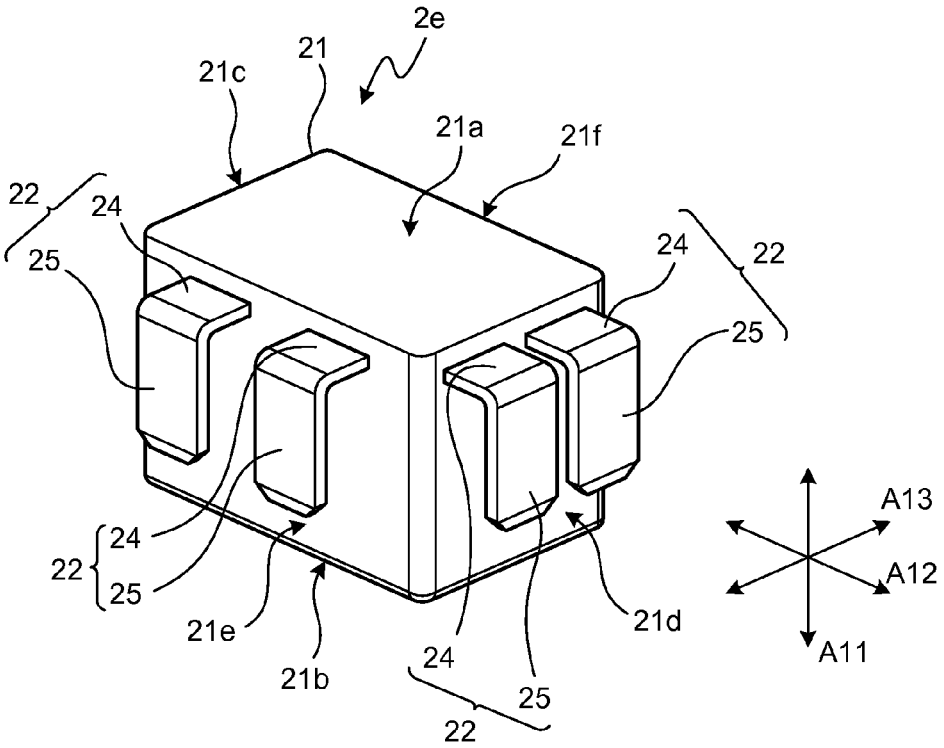
FIG. 11 is a perspective view illustrating a configuration of a relay according to a fifth modified example.

Further, FIGS. 10 and 11 illustrate configurations of a fourth modified example and a fifth modified example in which the base end 24 of the tab 22 protrudes from two adjacent side surfaces (the front surface 21*e* and the right side surface 21*d*) of the relay main body 21. In a relay 2*d* according to the fourth modified example illustrated in FIG. 10, three base ends 24 of the tabs 22 of four tabs 22 protrude from the vicinity of the upper end of the front surface 21*e* and the rest one base end 24 of the tab 22 protrudes from the right side surface 21*d* at the same height. On the contrary, in a relay 2*e* according to the fifth modified example illustrated in FIG. 11, two base ends 24 of the tabs 22 of four tabs 22 protrude from the vicinity of the upper end of the front surface 21*e* and the rest two base ends 24 of the tabs 22 protrude from the right side surface 21*d* at the same height.

Figure 12:
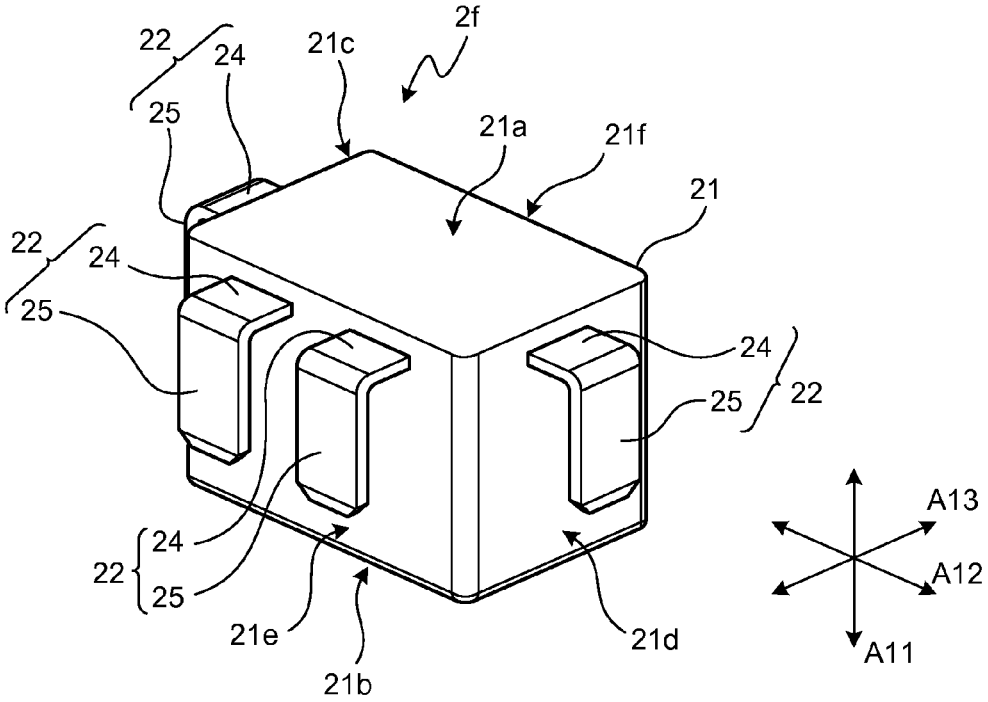
FIG. 12 is a perspective view illustrating a configuration of a relay according to a sixth modified example.

Then, FIG. 12 illustrates a configuration of a sixth modified example in which the base end 24 of the tab 22 protrudes from three side surfaces (the left side surface 21*c*, the front surface 21*e*, and the right side surface 21*d*) of the relay main body 21. In a relay 2*f* according to the sixth modified example, four tabs 22 are formed so that one tab protrudes from the left side surface 21*c*, two tabs protrude from the front surface 21*e*, and one tab protrudes from the right side surface 21*d*.

In the first modified example to the sixth modified example (FIGS. 7 to 12), the fitting portions 25 of four tabs 22 are curved substantially perpendicularly and downward from the protruding front ends of the base ends 24 and extend in parallel to the side surfaces from which the base ends 24 protrude. Further, the adjacent tabs 22 in the same side surface are arranged at the same interval (which may be different).

In the relay configurations illustrated in FIG. 4 and FIGS. 7 to 12, the base end 24 of the tab 22 protrudes from the side surface of the relay main body 21. However, the base end 24 may protrude from the top surface 21*a* of the relay main body 21 as in the seventh modified example to the eleventh modified example illustrated in FIGS. 13 to 17. In the seventh modified example to the eleventh modified example, the base ends 24 of four tabs 22 protrude from the top surface 21*a* and extend while being substantially perpendicularly curved toward the side surface.

Figure 13:
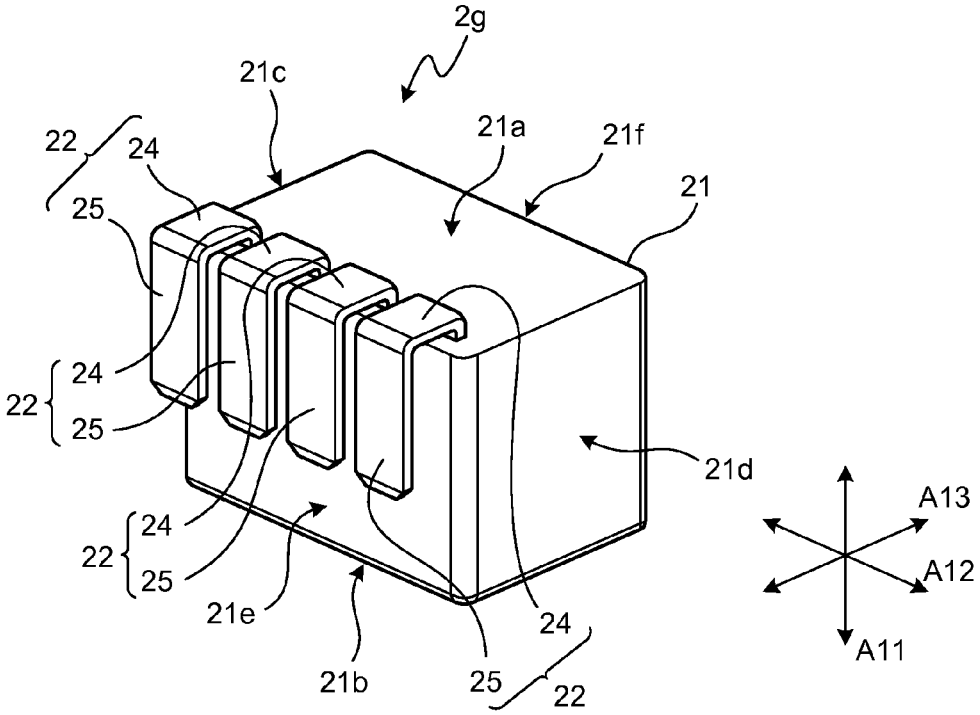
FIG. 13 is a perspective view illustrating a configuration of a relay according to a seventh modified example.
Figure 14:
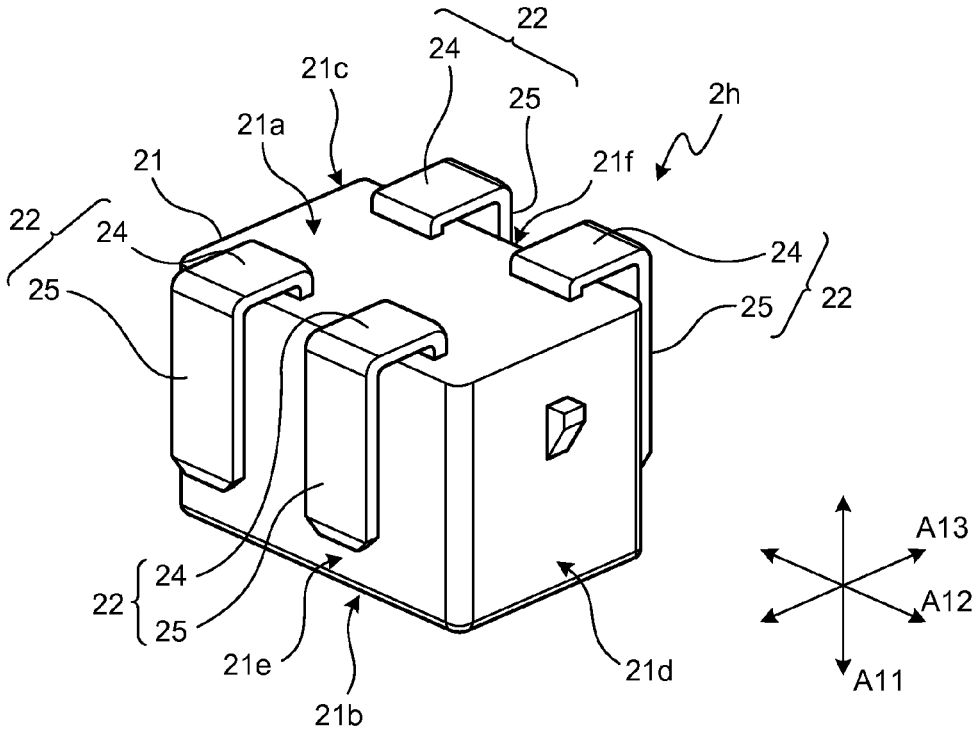
FIG. 14 is a perspective view illustrating a configuration of a relay according to an eighth modified example.
Figure 15:
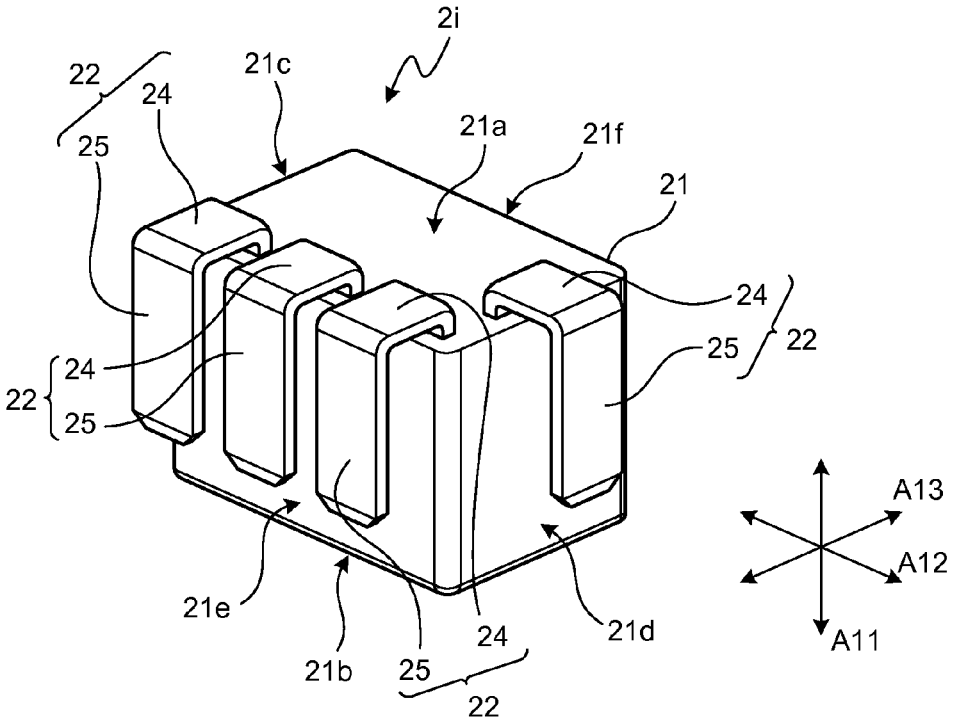
FIG. 15 is a perspective view illustrating a configuration of a relay according to a ninth modified example.
Figure 16:
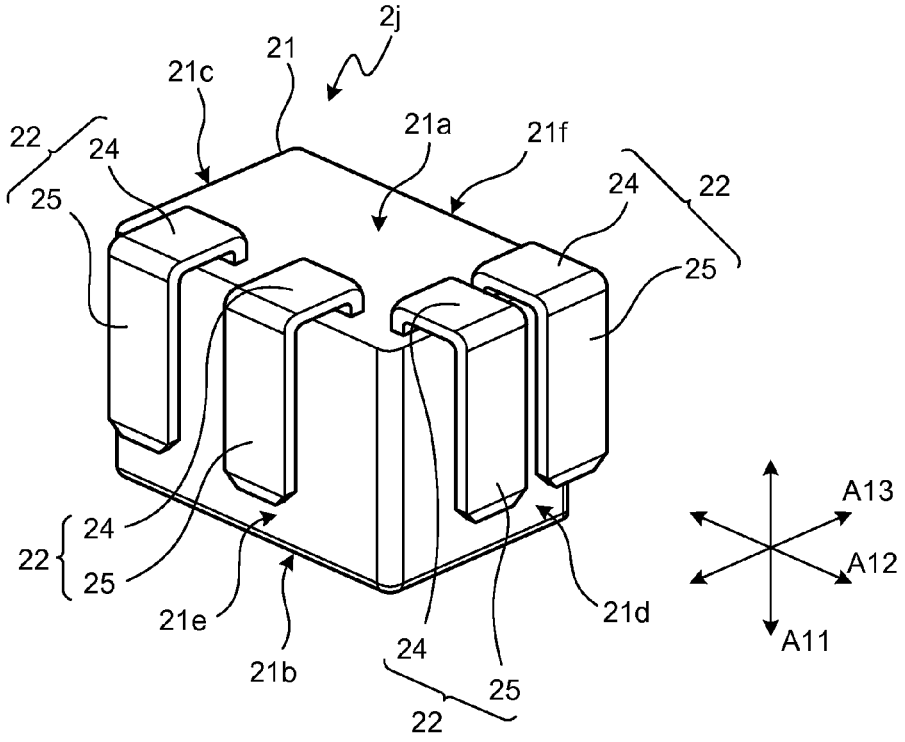
FIG. 16 is a perspective view illustrating a configuration of a relay according to a tenth modified example.
Figure 17:
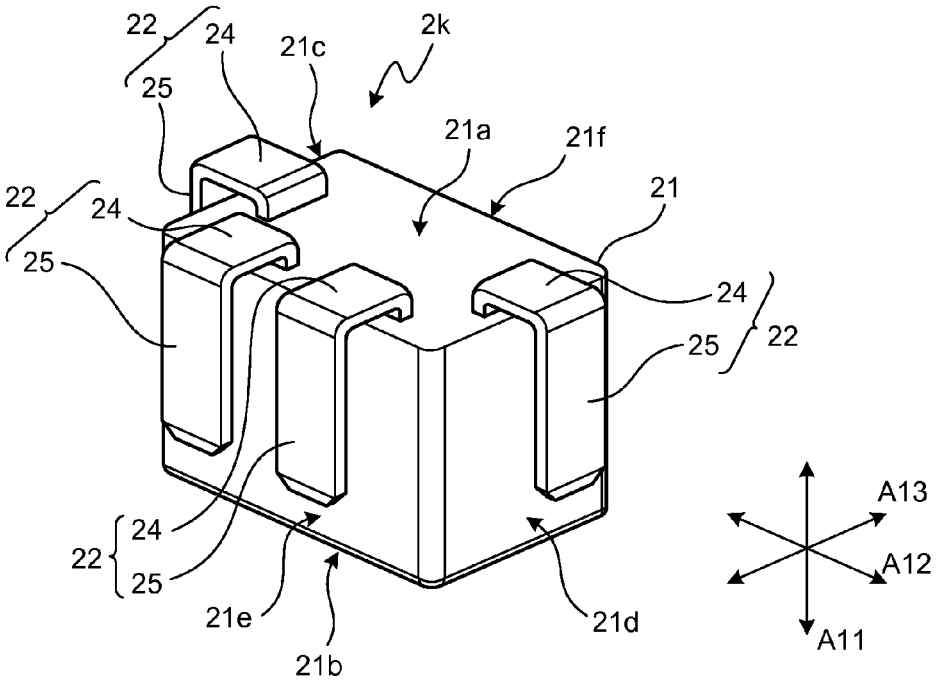
FIG. 17 is a perspective view illustrating a configuration of a relay according to an eleventh modified example.
Figure 18:
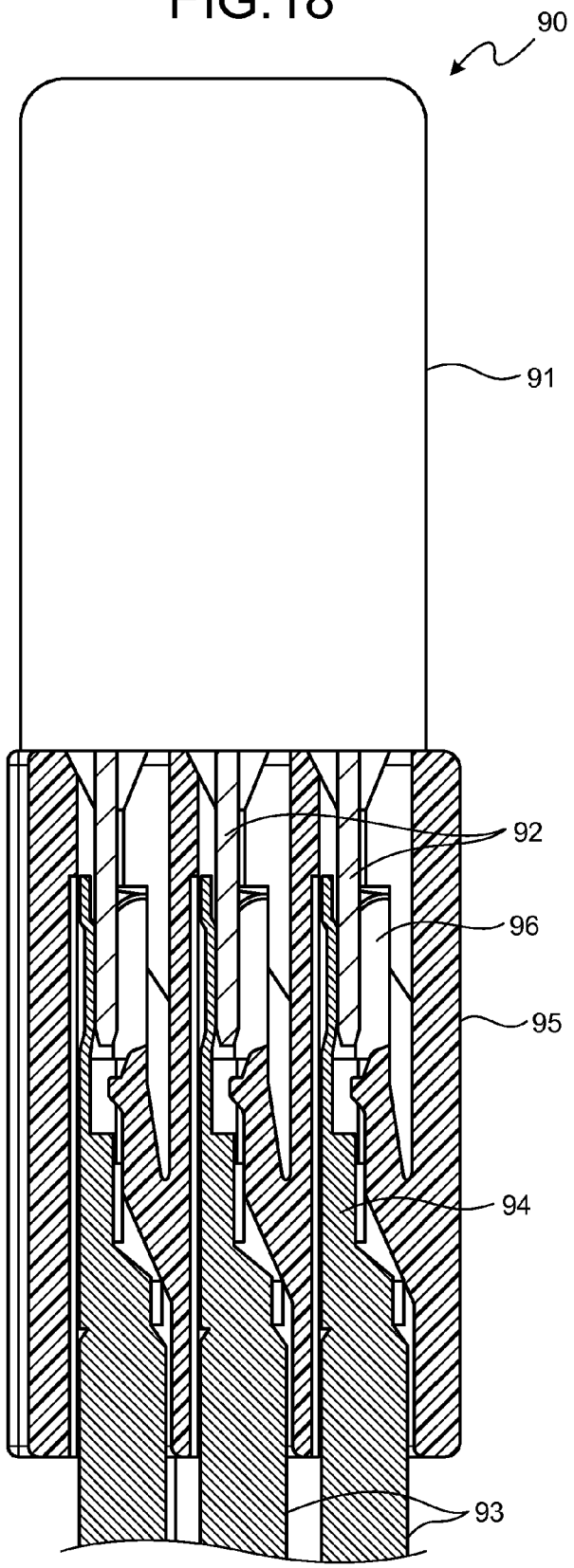
FIG. 18 is a longitudinal sectional view of a relay module of the related art.

In a relay 2*g* according to the seventh modified example illustrated in FIG. 13, the fitting portions 25 of four tabs 22 extend from the base ends 24 in parallel to the front surface 21*e*. In a relay 2*h* according to the eighth modified example illustrated in FIG. 14, two fitting portions of the fitting portions 25 of four tabs 22 extend from the base ends 24 in parallel to the front surface 21*e* and the rest two fitting portions extend in parallel to the back surface 21*f*. In a relay 2*i* according to the ninth modified example illustrated in FIG. 15, three fitting portions of the fitting portions 25 of four tabs 22 extend from the base ends 24 in parallel to the front surface 21*e*, and the rest one fitting portion extends in parallel to the right side surface 21*d*. In a relay 2*j* according to the tenth modified example illustrated in FIG. 16, two fitting portions of the fitting portions 25 of four tabs 22 extend from the base ends 24 in parallel to the front surface 21*e*, and the rest two fitting portions 25 of the tabs 22 extend therefrom in parallel to the right side surface 21*d*. Then, in a relay 2*k* according to the eleventh modified example illustrated in FIG. 17, one fitting portion of the fitting portions 25 of four tabs 22 extends from the base end 24 in parallel to the left side surface 21*c*, two fitting portions extend therefrom in parallel to the front surface 21*e*, and the rest one fitting portion extends therefrom in parallel to the right side surface 21*d*.

Figure 19A:
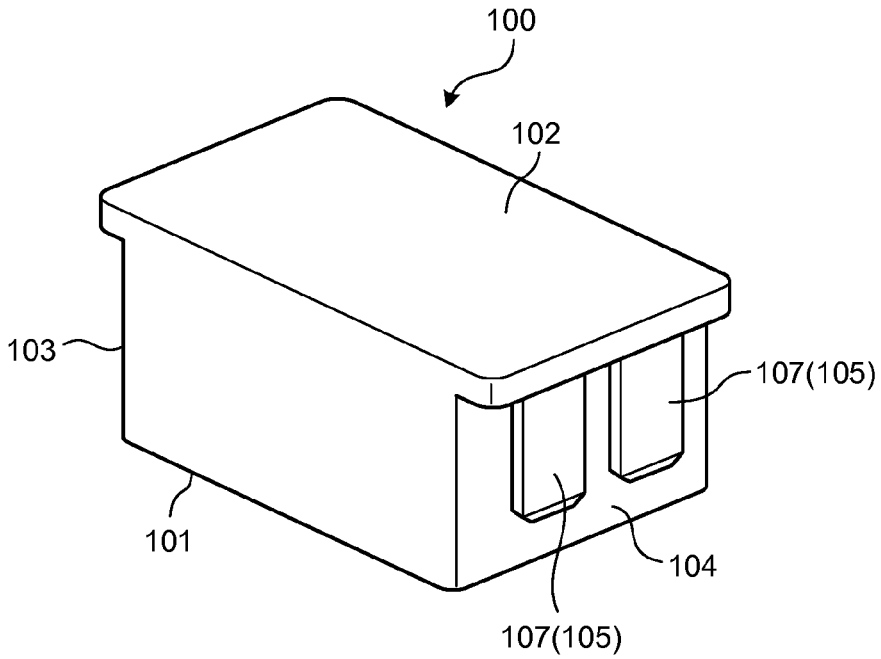
FIG. 19A is a perspective view of a relay in which a base end of a lead terminal is surrounded by a resin.

Further, in the above-described relays, the base end of the lead terminal is completely exposed, but at least a part of the base end may be surrounded by a resin. FIG. 19A is a perspective view of a relation in which a base end of a lead terminal is surrounded by a resin, and FIG. 19B is a side view of the relay illustrated in FIG. 19A.

Figure 19B:
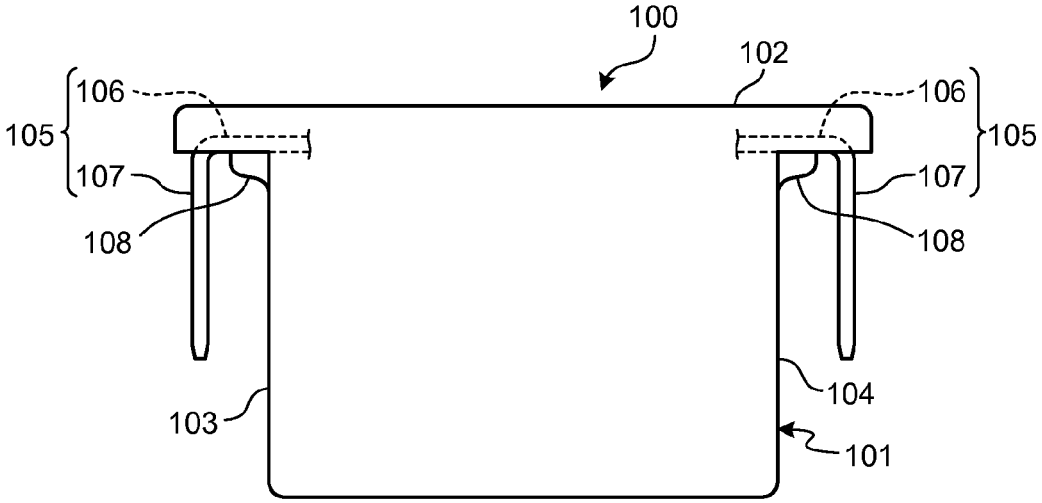
FIG. 19B is a side view of the relay illustrated in FIG. 19A.

As illustrated in FIGS. 19A and 19B, a relay 100 has a configuration in which an insulation member 102 having a flat plate shape is attached along one surface (for example, a surface corresponding to the top surface 21*a* of the embodiment) of a relay main body 101. The insulation member 102 is formed by molding an insulation resin so that the insulation member is formed in a substantially rectangular shape in the top view. The insulation member 102 extends in a direction perpendicular to a pair of opposite side surfaces 103 and 104 of the relay main body 101. Each of the side surfaces 103 and 104 is provided with two lead terminals 105. The lead terminals 105 are disposed so that a contact portion 107 faces the side surfaces 103 and 104. The insulation member 102 is formed so as to surround a base end 106 of each lead terminal 105.

As illustrated in FIG. 19B, the base end 106 of the lead terminal 105 is entirely surrounded by the insulation member 102 in the axial direction thereof, and the contact portion 107 of the lead terminal 105 is provided so as to protrude from the lower surface of the insulation member 102. A protrusion portion 108 is formed in a step shape at a position where the insulation member 102 intersects the side surfaces 103 and 104. The protrusion portion 108 contacts the upper end surface of the wall portion when the relay 100 is assembled to the housing member. In addition, the base end 106 of the lead terminal 105 may be disposed so as to protrude from the protrusion portion 108 or may be disposed so as to protrude from the side surfaces 103 and 104 of the relay main body 101.

Accordingly, it is possible to support the base end 106 of each lead terminal 105 by the insulation member 102 from the upside thereof. Thus, since it is possible to largely reduce a load on the lead terminal 105 when the lead terminal 105 is fitted into each terminal fitting, it is possible to prevent the deformation of the lead terminal 105. As a result, it is possible to satisfactorily keep the electric connection state between the lead terminal 105 and the terminal fitting and to prevent degradation in the holding force of the relay 100 with respect to the housing member. Further, since the base end 106 of each lead terminal 105 is surrounded by the insulation member 102, the short circuit between the adjacent lead terminals 105 can be prevented.

While the embodiments of the present invention have been described in detail with reference to the drawings, the above-described embodiments are merely examples of the present invention, and the present invention is not limited to only the configuration of the above-described embodiments. Of course, modifications in design within the scope not departing from the spirit of the present invention are included in the present invention.

According to the present invention, it is possible to improve the workability when the electronic component is assembled to the electronic component module.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An assembling structure of an electronic component, comprising:

an electronic component;

at least one terminal fitting configured to be fitted to the electronic component; and a housing member configured to accommodate the electronic component and the terminal fitting, wherein the electronic component includes a rectangular parallelepiped main body portion and at least one terminal portion provided in the main body portion, the housing member includes a first housing chamber which guides and accommodates the main body portion and a second housing chamber which accommodates and holds the terminal fitting, the first housing chamber is formed by a frame-shaped wall portion rising from a bottom portion of the housing member so as to circumscribe the main body portion, and the second housing chamber is formed at an outside with the wall portion interposed therebetween, the terminal portion includes a base end and a fitting portion which extends from a protruding front end of the base end along a side surface of the main body portion while being separated from the side surface and is fitted to the terminal fitting, the fitting portion of at least one terminal portion is positioned so as to contact the terminal fitting when at least one third of a height dimension of the main body portion is accommodated in the first housing chamber, and the electronic component, the terminal fitting, and the housing member are assembled each other.

2. An electrical junction box comprising:

the assembling structure of the electronic component according to claim 1.

3. The assembling structure of the electronic component according to claim 1, wherein the electronic component includes a plurality of terminal portions, the second housing chamber accommodates and holds a plurality of the terminal fittings respectively fitted to the plurality of terminal portions, the fitting portions of the plurality of terminal portions are disposed so that the extension front ends are positioned at the same height position, and the plurality of terminal fittings is positioned at the same height position.

4. The assembling structure of the electronic component according to claim 3, wherein the plurality of terminal portions is provided so that at least one terminal portion is provided in the opposite side surfaces, respectively of the main body portion, and the plurality of terminal fittings includes inclined portions which guide the fitting portions of the terminal portions, and the inclined portions are positioned so as to be inclined in the opposite direction at both sides with the main body portion interposed therebetween.

5. An electrical junction box comprising:

the assembling structure of the electronic component according to claim 4.

6. An electrical junction box comprising:

the assembling structure of the electronic component according to claim 3.

7. The assembling structure of the electronic component according to claim 1, wherein the electronic component includes a plurality of terminal portions, the second housing chamber accommodates and holds the plurality of terminal fittings respectively fitted to the plurality of terminal portions, a part or the entirety of the terminal portions among the plurality of terminal portions are disposed so that the extension front ends are positioned at different height positions, and a part or the entirety of the terminal fittings among the plurality of terminal fittings are positioned at different height positions.

8. The assembling structure of the electronic component according to claim 7, wherein the plurality of terminal portions is provided so that at least one terminal portion is provided in the opposite side surfaces, respectively of the main body portion, and the plurality of terminal fittings includes inclined portions which guide the fitting portions of the terminal portions, and the inclined portions are positioned so as to be inclined in the opposite direction at both sides with the main body portion interposed therebetween.

9. An electrical junction box comprising:

the assembling structure of the electronic component according to claim 7.

* * * * *